US005095970A

United States Patent [19]

Klein et al.

[11] Patent Number: 5,095,970

[45] Date of Patent: Mar. 17, 1992

[54] CONTINUOUS-CASTING MOLD FOR VERTICALLY CASTING METAL STRIP

[75] Inventors: Adolf Klein, Jedesheim; Hilmar R. Muller, Bellenberg; Joachim Rabenschlag, Neu-Ulm; Jorg Steeb, Tiefenbach, all of Fed. Rep. of Germany

[73] Assignee: Wieland-Werke A.G., Ulm, Fed. Rep. of Germany

[21] Appl. No.: 545,354

[22] Filed: Jun. 27, 1990

[30] Foreign Application Priority Data

Jun. 28, 1989 [EP] European Pat. Off. ..... 89111727.7

[51] Int. Cl.[5] ..... B22D 11/124

[52] U.S. Cl. ..... 164/485; 164/443

[58] Field of Search ..... 164/443, 485

[56] References Cited

FOREIGN PATENT DOCUMENTS

| | | | |
|---|---|---|---|
| 0138802 | 4/1985 | European Pat. Off. | 164/443 |
| 0212248 | 3/1987 | European Pat. Off. . | |
| 3640525 | 6/1988 | Fed. Rep. of Germany . | |
| 52-74529 | 6/1977 | Japan | 164/443 |
| 1-143742 | 6/1989 | Japan | 164/443 |
| 641984 | 6/1980 | Switzerland . | |
| 952422 | 8/1982 | U.S.S.R. | 164/443 |

*Primary Examiner*—Kuang Y. Lin
*Attorney, Agent, or Firm*—Ladas & Parry

[57] ABSTRACT

A continuous-casting mold for vertically casting metal strip, in particular for strip casting of copper and copper alloys, in which a mold insert has a casting opening of rectangular cross-section, and the body is provided with an outer cooling device. In order to ensure uniform cooling of the strand, the cooling device is arranged solely on the wide sides of the mold body and, starting from a bottom edge of the mold, the cooling device extends approximately up 55–75% of the height of the wide sides, the narrow sides being uncooled.

15 Claims, 3 Drawing Sheets

CONTINUOUS-CASTING MOLD FOR VERTICALLY CASTING METAL STRIP

FIELD OF THE INVENTION

This invention relates to a continuous-casting mold for vertically casting metal strip.

BACKGROUND OF THE INVENTION

In the continuous casting of large, rectangular shapes, continuous-casting molds, inter alia, are used in which a mold insert is completely surrounded by a cooling device.

The use of continuous-casting molds of the said type in the casting of strips in the thickness range of about 6–30 mm is not possible, since the cooling is too intense, in particular in the corner area of the mold cavity defining means, hereinafter referred to as a mold body, so that excessive preliminary solidification of the melt occurs in the corner area, while closer to the center of the mold body the melt is still liquid so that there is the risk of breakout of the strand, particularly during the starting operation.

The object of the invention is therefore to provide a continuous-casting mold in such a way that uniform cooling of the strand is ensured.

SUMMARY OF THE INVENTION

The object is achieved according to the invention in that the cooling device is arranged solely on the wide sides of the mold cavity defining body and, starting from the bottom edge of the mold, extends approximately up to 55–75% of the height of the wide side, and in that the narrow sides are uncooled.

It has been found that, due to the design according to the invention of the continuous-casting mold, the cooling becomes more uniform so that an approximately uniform level of the solid-liquid interface is obtained over the cross-section of the casting opening.

In a preferred embodiment of the invention, the cooling device extends approximately over the lower two-thirds of the height of the wide sides.

A two-channel cooling system is preferably provided at each wide side of the mold body. In such an arrangement, conveniently each said two-channel system has vertical cooling channels in the outer wall of the wide side of the mold body, said vertical cooling channels being connected by bores to a lower, horizontally extending feed channel for cooling liquid and an upper, horizontally extending discharge channel for the cooling liquid.

For reasons of simpler manufacture, the mold body preferably comprises two spaced, opposed plates forming the respective wide sides and two spaced, opposed plates forming the respective narrow sides thereof. Plates made of metallic materials are preferably used.

In order to further provide a more uniform cooling effect, it is advantageous for insulating plates to be inserted on the inside of the mold body in the upper, uncooled area A of the plates forming the wide sides of the mold body. Alternatively, to obtain the same effect, the plates forming the narrow sides of the mold body can be made of a non-metallic material. This embodiment also has the advantage that inductive control of the casting level is possible.

In order to reduce the heat flow from the upper, uncooled area A to the lower, cooled area $A_c$, a horizontal separating slot is preferably arranged in the outer wall of each wide side of the mold body. To control the thermal distortion of the uncooled metallic area A, it is advisable for a strip made of a non-metallic material having low thermal conductivity and a relatively large coefficient of expansion to be pressed into the horizontal separating slot.

At a metallic uncooled area A there is the risk of the area A expanding to such an extent that, at a high level of filling and low casting speed, the strand becomes too thick and does not fit through the cooled area $A_c$. The consequence would be a strand break. In an alternative embodiment, it is therefore proposed that the upper, uncooled area A of the mold body be made of non-metallic materials of low thermal conductivity, and that the lower, cooled area $A_c$ be made of metallic materials. In order to prevent any penetration of liquid melt, the components of the uncooled area A are preferably pressed into the components of the cooled area $A_c$. Again for reasons of simpler manufacture, the components of the uncooled area A are formed from four plates or from two L-shapes.

To intensify the cooling of the strand emerging from the mold, a secondary cooling means having flat-jet nozzles can be arranged downstream from the mold in the withdrawal direction of the strand.

A feature of the invention provides a process for strip casting with the use of a continuous-casting mold according to the invention. The process is characterised in that the casting level during the casting is kept approximately within the upper, uncooled third of the mold. In such a process, the casting level is preferably kept at a height approximately 20–50 mm below the top edge TE of the mold.

BRIEF DESCRIPTION OF THE DRAWINGS

The invention will now be described in greater detail with reference to the following exemplary embodiment. In the drawings.

In the Figures, like reference numerals denote like parts.

DESCRIPTION OF THE PREFERRED EMBODIMENT

Figure 1:
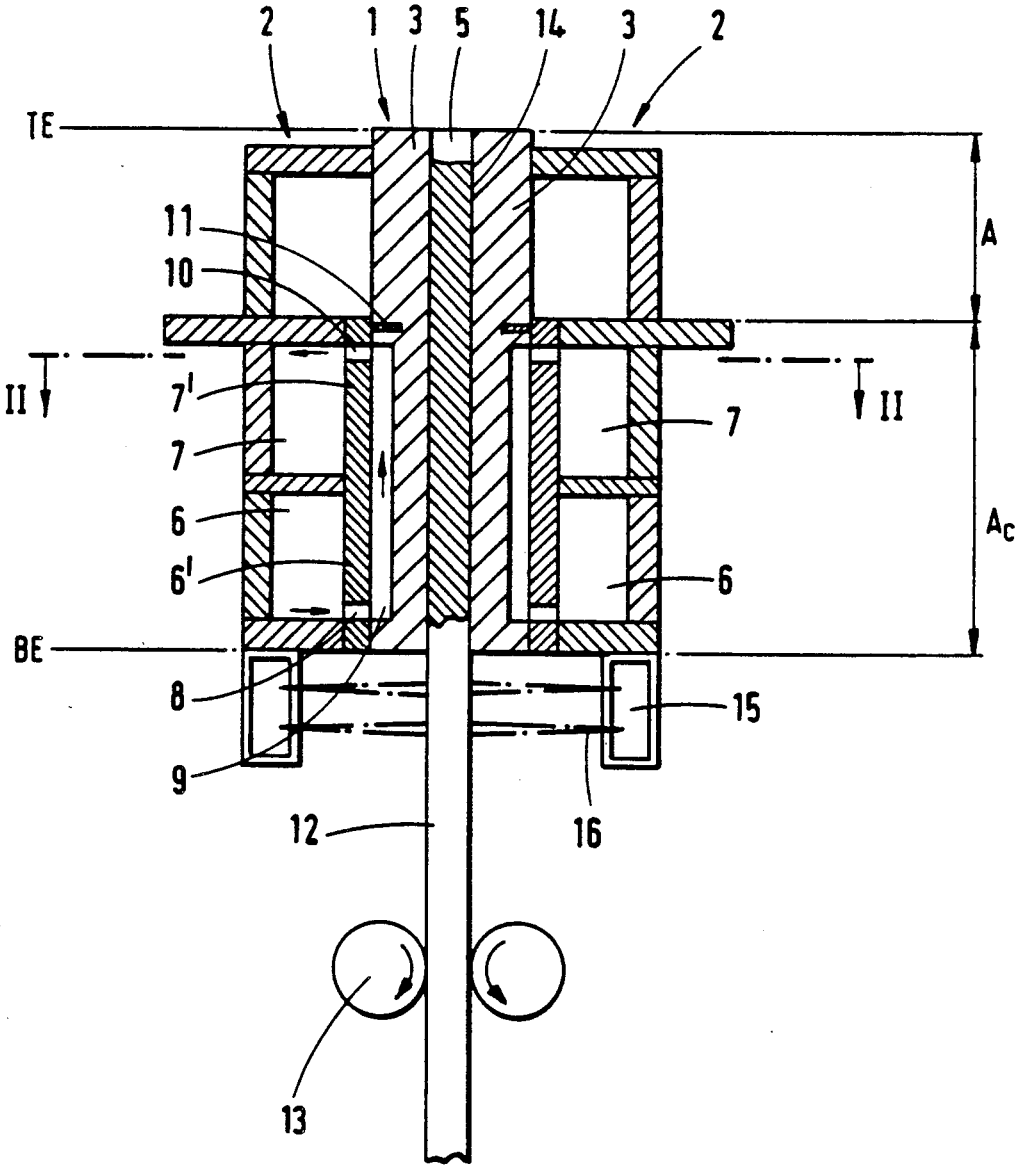
FIG. 1 shows a vertical cross-section of a continuous-casting mold in accordance with this invention.
Figure 2:
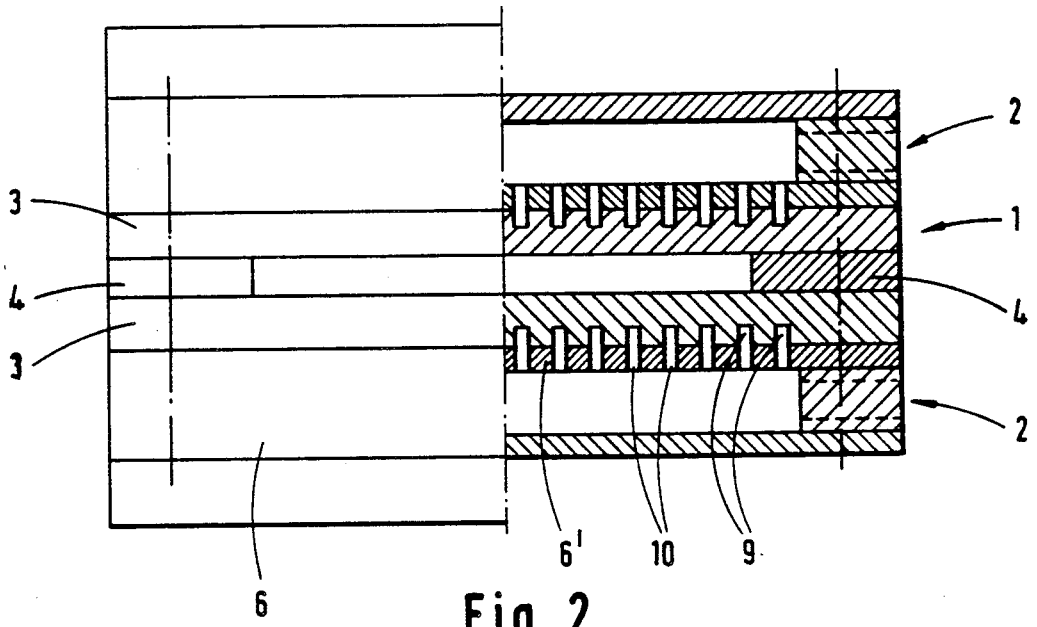
FIG. 2 shows a combined plan view and a horizontal section along double arrow-headed line II—II of FIG. 1.
Figure 3:
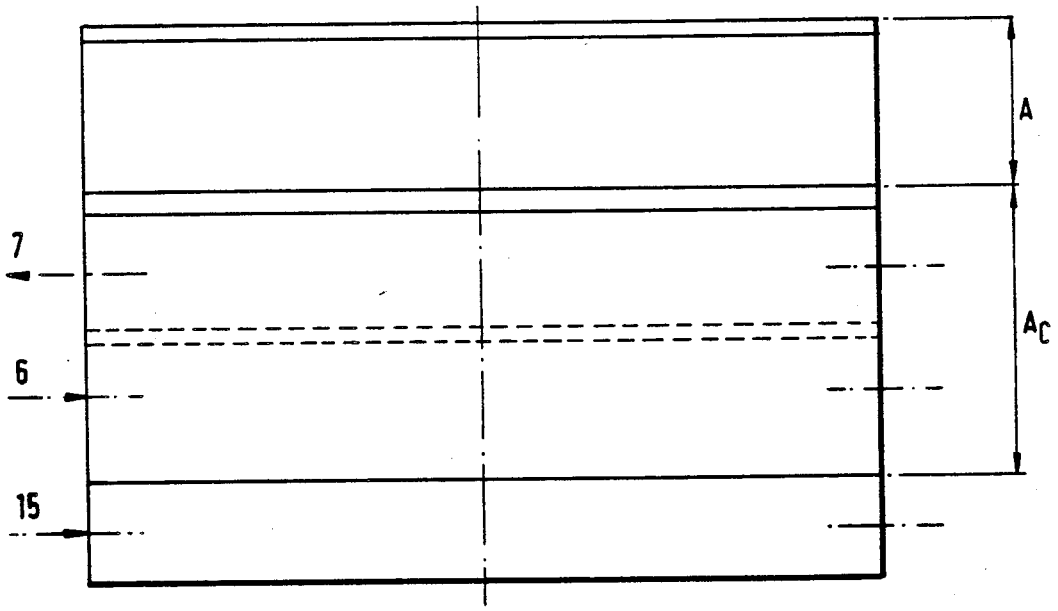
FIG. 3 shows a side view of the wide side of the mold shown in FIG. 1.

The continuous-casting mold for vertically strip casting metals shown in FIGS. 1 to 3 has a metallic mold cavity defining body 1 and a cooling device 2. The body 1 is formed by a pair of spaced, opposed plates 3 and a pair of spaced, opposed plates 4 which respectively form the wide sides and narrow sides of the body 1. The plates 3, 4 are held together by bolts (not shown). A casting opening 5 of rectangular cross-section for receiving the molten metal is thus obtained. The plates 3, 4 can be made, for example, of copper; further possibilities for the material of plates 3, 4 will be discussed hereinbelow.

The cooling device 2 is arranged solely on the wide sides of the body 1 in such a way that, starting from the bottom edge BE of the mold, it extends approximately upwardly 55–75% of the height of the wide sides, preferably over the lower two-thirds of the height of the wide sides. The remaining upper area of the wide sides (that is, preferably the upper third) as well as the narrow sides of the insert 1 remain uncooled. The lower, cooled area of the wide sides is identified in FIG. 1 by $A_c$ and the upper, uncooled area by A. The support of the insert 1 in the area of length A is effected merely for reasons of stability.

The cooling device 2 consists of two two-channel cooling systems of identical construction which are arranged on each of the wide sides (plates 3) of the body 1, and a cooling liquid (in particular water) is supplied through a lower, horizontal feed channel 6 and drawn off through an upper, horizontal discharge channel 7. From the channel 6, the cooling liquid passes via bores 8, directed orthogonally to the body 1 axis, in the channel wall 6', via vertical cooling channels 9 in the outer wall of the plate 3 and via bores 10, also directed orthogonally to the insert 1 axis, in the channel wall 7' into the channel 7. The flow direction of the cooling liquid is identified by arrow headed lines. In FIG. 3, the arrow headed lines designate the feed of the cooling liquid to the channel 6 and the discharge of the cooling liquid from the channel 7.

Figure 4:
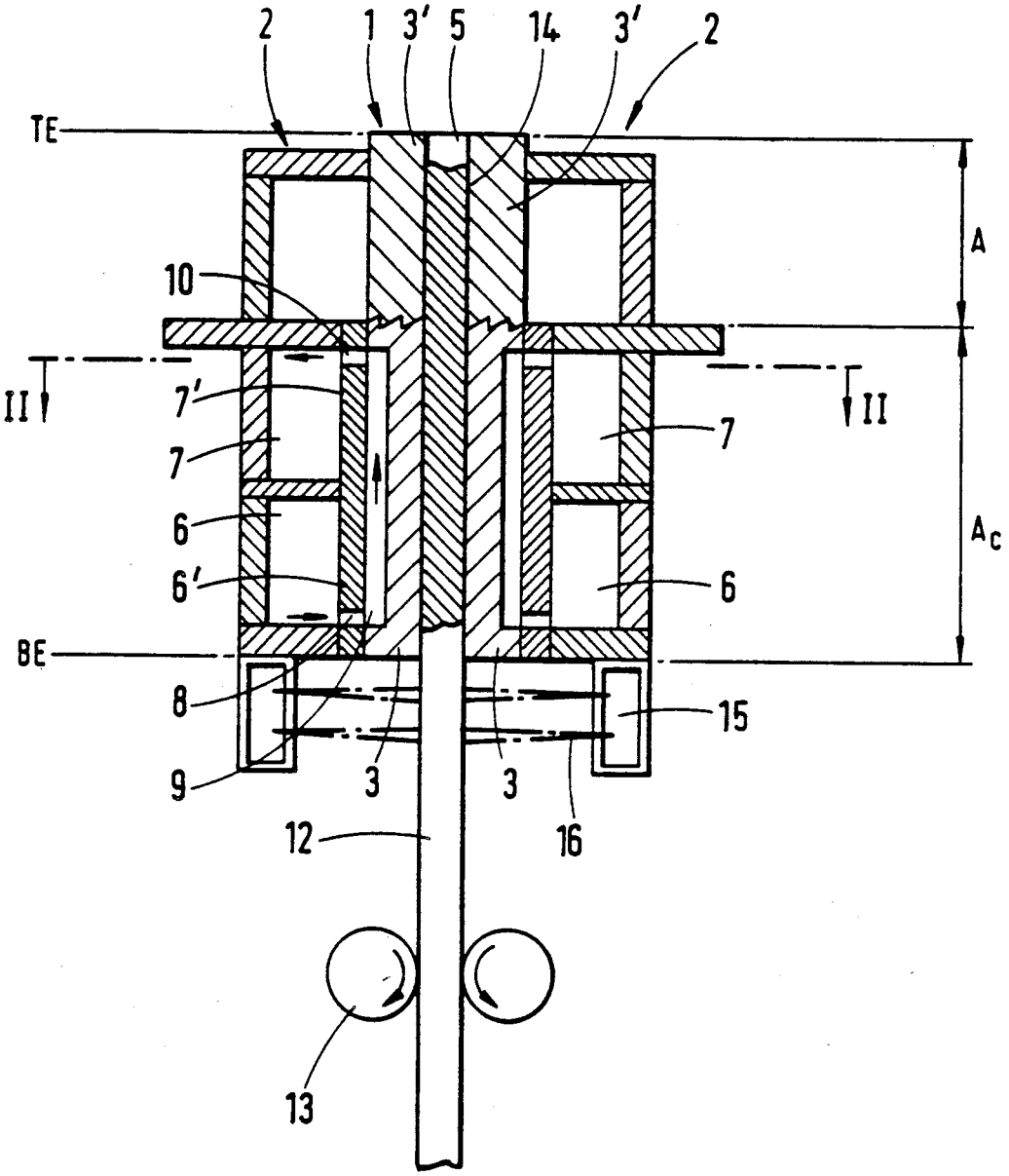
FIG. 4 shows a vertical cross-section of another embodiment of the continuous-casting mold of this invention.

In order to reduce the heat flow from the upper, uncooled area A of the wide sides to the lower, cooled area $A_c$, a horizontal separating slot 11 is provided on the outer wall of the respective plates 3 and a strip of non-metallic material having low thermal conductivity and a relatively large coefficient of expansion may be pressed into the slot alternatively, as shown in FIG. 4, the upper uncooled part of the mold body 3' may be made of non-metallic material of low thermal conductivity and the lower cooled part of the mold body may be made of metallic material, the lower and upper parts being press-fitted to one another.

To perform the casting process, molten metal is supplied to the continuous-casting mold from a distributor device (not shown). The developing metal strand 12 is drawn off by schematically indicated withdrawal roller members 13. During the casting operation, the liquid metal shown by x-hatching lines preferably has casting level 14 which is kept in the upper (uncooled) one third of the continuous-casting mold.

If required, a secondary cooling means 15 having flat-jet nozzles 16 can be arranged downstream from the continuous-casting mold in the withdrawal direction of the strand 12.

Due to the construction of the body 1, it is readily possible to exchange the plates 4 forming the narrow sides in order to cast different strip thicknesses. In addition, metal plates 4 can be replaced by plates 4 made of non-metallic materials (for example graphite), which in particular permits inductive control of the casting level 14.

EXEMPLARY EMBODIMENT

Brass strips (CuZn30) of the dimensions 25×400 mm were cast with a continuous-casting mold of the type described.

For this purpose, molten brass heated to about 1050° C. was fed to a mold insert 1 consisting of copper plates. The dimensions of the casting opening were 25×400×360 mm.

Cooling was effected by means of water through a cooling device 2 which extended over 250 mm (cooled area $A_c$) and through downstream secondary cooling means 15 having flat-jet nozzles 16.

The casting level 14 was kept in the upper (uncooled) third of the mold, and approximately 20–50 mm below the top edge TE of the mold.

The withdrawal speed was approximately 500–100 mm/min.

Starting of the casting operation was carried out without any problem arising. Brass strips having a satisfactory surface quality were obtained.

Having thus described the invention with reference to a specific embodiment, it is to be understood that change may be made without departing from the spirit and scope of the invention as defined by the appended claims.

We claim:

1. A continuous-casting mold for vertically casting metal strip comprising means defining a mold cavity having a casting opening of rectangular cross-section, and an outer cooling device arranged solely on spaced, opposed wide sides of the mold cavity defining means which, starting from a bottom edge of the mold cavity defining means, extend approximately upwardly 55%–75% of the height of the wide sides, the spaced, opposed narrow sides of the mold cavity defining means being uncooled.

2. A continuous-casting mold according to claim 1, wherein the cooling device extends approximately over the lower two-thirds of the height of the wide sides.

3. A continuous-casting mold according to claim 1, wherein a two-channel cooling system is provided at each wide side of the mold cavity defining means.

4. A continuous-casting mold according to claim 3, wherein each said two-channel system has vertical cooling channels in respective outer walls of the wide side of the mold cavity defining means, said vertical cooling channels being connected by bores to a lower, horizontally extending feed channel for cooling liquid and an upper, horizontally extending discharge channel for the cooling liquid.

5. A continuous-casting mold according to claim 1, wherein the mold cavity defining means comprises two spaced, opposed plates forming the respective wide sides and two spaced, opposed plates forming the respective narrow sides thereof.

6. A continuous-casting mold according to claim 5, wherein said plates are made of metallic materials.

7. A continuous-casting mold according to claim 5, wherein insulating plates are inserted on the inside of the mold cavity defining means in the upper, uncooled area of the plates forming the wide sides of said mold cavity defining means.

8. A continuous-casting mold according to claim 5, wherein the plates forming the narrow sides of the mold cavity defining means are made of a non-metallic material.

9. A continuous-casting mold according to claim 6, wherein a horizontal separating slot is arranged in the outer wall of each wide side of the mold cavity defining means, which separating slot partly separates the upper, uncooled area of the mold from the lower, cooled area of the mold.

10. A continuous-casting mold according to claim 9, wherein a strip made of a non-metallic material having low thermal conductivity and a relatively large coefficient of expansion is press fitted into said horizontal separating slot.

11. A continuous-casting mold according to claim 1, wherein the upper, uncooled area of the mold cavity defining means is made of non-metallic materials of low thermal conductivity, and the lower, cooled area is made of metallic materials.

12. A continuous-casting mold according to claim 11, wherein the components of the uncooled area are pressed into the components of the cooled area.

13. A continuous-casting mold according to claim 1, wherein a secondary cooling means having flat-jet nozzles is arranged downstream from the mold in the withdrawal direction of the strand.

14. A process for casting in a continuous mold including the steps of defining a mold cavity having a rectangular cross-section such that said mold cavity has opposed wide sides interconnected by opposed narrow sides and a rectangular casting opening, cooling only said opposed wide sides from a bottom edge of said mold cavity upwardly 55%–75% of the height of said wide sides, pouring a molten metal into said mold cavity through said casting opening, and maintaining the melt level during casting in the upper uncooled part of the mold cavity.

15. A process according to claim 14 wherein the casting level is kept to a level approximately 20 mm–50 mm below the top edge of the mold cavity.

* * * * *